US012071834B2

(12) United States Patent
Low et al.

(10) Patent No.: US 12,071,834 B2
(45) Date of Patent: Aug. 27, 2024

(54) DOWNHOLE CUTTING TOOL

(71) Applicant: CORETRAX GLOBAL LIMITED, Aberdeen (GB)

(72) Inventors: Ryan Low, Arbroath (GB); John Paul Fraser, Montrose (GB); Cherish Caledonia Bodman, Montrose (GB); Scott Alexander James Main, Aberdeen (GB)

(73) Assignee: CORETRAX GLOBAL LIMITED, Portlethen (GB)

( * ) Notice: Subject to any disclaimer, the term of this patent is extended or adjusted under 35 U.S.C. 154(b) by 18 days.

(21) Appl. No.: 17/775,469

(22) PCT Filed: Nov. 9, 2020

(86) PCT No.: PCT/EP2020/025502

§ 371 (c)(1),
(2) Date: May 9, 2022

(87) PCT Pub. No.: WO2021/089191

PCT Pub. Date: May 14, 2021

(65) Prior Publication Data

US 2022/0389796 A1 Dec. 8, 2022

(51) Int. Cl.
*E21B 43/112* (2006.01)
*E21B 17/06* (2006.01)

(52) U.S. Cl.
CPC ..... *E21B 43/112* (2013.01); *E21B 17/06* (2013.01)

(58) Field of Classification Search
CPC ..... E21B 43/112; E21B 17/06
USPC ..... 166/55.2
See application file for complete search history.

(56) References Cited

U.S. PATENT DOCUMENTS

| | | | |
|---|---|---|---|
| 5,224,558 | A | 7/1993 | Lee |
| 5,339,914 | A | 8/1994 | Lee |
| 6,041,874 | A | 3/2000 | Lee |
| 6,732,793 | B1 | 5/2004 | Lee |
| 6,923,255 | B2 | 8/2005 | Lee |
| 7,347,288 | B2 | 3/2008 | Lee |
| 7,347,289 | B2 | 3/2008 | Lee |
| 7,673,708 | B2 | 3/2010 | Lee |
| 7,866,397 | B2 | 1/2011 | Lee |

(Continued)

FOREIGN PATENT DOCUMENTS

| | | |
|---|---|---|
| CA | 1285264 C | 6/1991 |
| EP | 3266976 A1 | 1/2018 |

(Continued)

OTHER PUBLICATIONS

International Search Report for Application No. PCT/EP2020/025502 dated Dec. 22, 2020.

*Primary Examiner* — Taras P Bemko
(74) *Attorney, Agent, or Firm* — Patterson + Sheridan, LLP

(57) ABSTRACT

A downhole cutting tool (13) for perforating a tubular (14) in an oil or gas well comprises a body (4); radially moveable cutting members (3) mounted on the body (4); a helical profiled member (1) rotatable relative to the body (4); and activation members (2) axially movable relative to the body (4). Rotation of the helical profiled member (1) generates axial movement of the activation members (2), and the activation members (2) configured to actuate the cutting members (3) from a retracted configuration to an extended configuration.

16 Claims, 10 Drawing Sheets

(56) References Cited

U.S. PATENT DOCUMENTS

| | | | | |
|---|---|---|---|---|
| 7,891,441 | B2 | 2/2011 | Lee | |
| 8,104,549 | B2 | 1/2012 | Lee | |
| 9,133,666 | B2 | 9/2015 | Lee | |
| 9,187,989 | B2 | 11/2015 | Lee | |
| 9,617,812 | B2 | 4/2017 | Lee | |
| 10,370,908 | B2 | 8/2019 | Lee et al. | |
| 2007/0012440 | A1 | 1/2007 | Lee | |
| 2008/0314561 | A1* | 12/2008 | Lewis | F28F 9/0246 165/166 |
| 2010/0258289 | A1 | 10/2010 | Lynde et al. | |
| 2013/0000923 | A1 | 1/2013 | Lee | |
| 2014/0291031 | A1* | 10/2014 | Lee | E21B 34/14 175/237 |
| 2016/0160578 | A1 | 6/2016 | Lee | |
| 2016/0177658 | A1 | 6/2016 | Lee | |
| 2016/0215596 | A1* | 7/2016 | Cook | E21B 43/112 |
| 2016/0258257 | A1* | 9/2016 | Babin | E21B 29/005 |
| 2019/0186224 | A1 | 6/2019 | Beazer et al. | |
| 2022/0307341 | A1* | 9/2022 | Harms | E21B 43/119 |

FOREIGN PATENT DOCUMENTS

| | | | |
|---|---|---|---|
| GB | 2256884 | A | 12/1992 |
| GB | 2268770 | B | 1/1994 |
| GB | 2285076 | A | 6/1995 |
| GB | 2313860 | A | 12/1997 |
| GB | 2499224 | A | 8/2013 |
| WO | 2005094166 | A2 | 10/2005 |
| WO | 2012098377 | A2 | 7/2012 |
| WO | 2015065328 | A1 | 5/2015 |
| WO | 2015073011 | A1 | 5/2015 |

* cited by examiner

DOWNHOLE CUTTING TOOL

FIELD

The present disclosure relates to a cutting tool for cutting a downhole well tubular and relates to a sealing apparatus for providing an annular seal in a downhole well bore. The present disclosure relates particularly, but not exclusively to a downhole work string incorporating such a cutting tool and/or anchor and/or seal apparatus and to a method of completion or abandonment of a hydrocarbon well using such a work string.

BACKGROUND

In most oil and gas wells, a conduit is run through the productive zone to keep the formation from breaking down and falling into the wellbore. To produce oil and/or gas from the well, the conduit must be perforated so the producing fluid can enter the well bore and be extracted. The most common technique for perforating a well conduit is to use explosives and blow holes in the conduit at predetermined intervals. However, it is desirable to be able to perforate the well in a more controlled and reliable manner.

Currently, there are existing tools on the market that perform multiple single penetrations to the well conduit, activated hydraulically via a series of pistons. A tool having such features is described in WO2012098377.

It is also desirable to provide a reliable and repeatable method of fracturing formations to enable the production of oil and gas once the wellbore has been perforated. To accomplish this, it is desirable to provide a packer and/or plug apparatus that enables sections of perforated well wellbores to be reliably isolated and sealed to enable hydraulic fracturing to take place.

Furthermore, perforating the downhole tubulars can be desirable during the latter stages of the well cycle. During the abandonment phase, for example, it can be necessary to perforate the conduit to conduct a remedial cement squeeze into the annular. To successfully abandon the wellbore, a combination of mechanical barriers and cement plugs are required. In some instances, access behind an existing conduit is required to remove residual fluids and/or to place cement into the annulus. In these cases, remedial work such as section milling can be conducted to gain access to the B-annulus, that is the annulus between casings, however this can be a time-consuming process. An alternative to this method is to perforate the conduit.

SUMMARY

According to a first aspect of the present disclosure, there is provided a downhole tubular cutting tool for perforating a downhole well, the tool comprising: a tool body and an activation member. The tool body may be arranged to be used in a wellbore and may contain at least one or a plurality of cutting members that are moveable radially outward. The cutting members may be activated by mechanical means and may be activated singularly or in sequence. The activation member may be disposed in the body, wherein the member may provide mechanical means of activation that may be generated from a helical member rotated via drill string torque, and the rotational movement may move an activation member axially down the helical profiled member. The helical profiled member may be disposed within the tool body.

According to a second aspect of the present disclosure there is provided a downhole cutting tool designed to be run into a wellbore for creating cuts in the wellbore conduit which may be but are not limited to slits, perforations, rips, tears, slices, and/or other punctures. The tool may comprise a tool body attached to a drill string to be run in a wellbore with at least one cutting member moveable radially outward from activation members moving along the tool axis via a mechanical means. The cutting members can be activated singularly or in sequence or in unison.

The mechanical means of activation may be generated from a helical profiled member rotated via drill string torque; the rotational movement will move an activation member axially along the helical profiled member. The helical profiled member may be disposed within the main tool body.

The tool may comprise a tool body arranged to be used in a wellbore containing at least one or a plurality of cutting members that are moveable radially outward. The cutting members may be activated by mechanical means and may be activated singularly or in sequence.

At least one activation member may be disposed in the tool body, and the activation member may provide mechanical means of activation generated from rotation of helical profiled member(s), optionally driven by drill string torque. The rotational movement may move one or more activation member(s) axially down the helical profiled member. Optionally the helical profiled member(s) is disposed of within the tool body.

The tool may comprise an anchor mechanism to secure the tool in the wellbore, set by hydraulic or mechanical means. The anchor mechanism may contain a series of slips that when activated contact the wellbore wall and anchor the tool assembly to prevent rotational and/or axial movement. Optionally, the anchor mechanism may have one or more hydraulically or mechanically activated annular seal(s) incorporated which can be temporary or permanent in nature. The anchor mechanism can be disconnected from the drill string whilst remaining in position within the wellbore. The anchor mechanism preferably maintains a through bore which allows fluids and members to pass through the bore of the tool.

The downhole tubular cutting tool is designed to be run into the wellbore using mechanical force as a method of creating cuts in the wellbore tubular which may be in the form of slits, perforations, rips, tears, slices and/or other punctures. The cuts created by the tool may be helical in nature and not limited in length, width, or shape of cut. The cutting tool may provide a method of making cuts in the conduit without the need for explosive charges or hydraulic forces.

The cutting tool may be run on drill pipe and/or tubing into the wellbore. The tool may then be anchored into casing by the anchor mechanism, in the area the cuts are to be made. The rotation of the drill pipe/tubing may be used to activate the helical profiled member(s) at the top of the cutting tool. A pre-determined torque value and/or turns/rotations may start the process. One or more activation member(s) may move axially down the helical profiled member(s), creating an axial force that drives the cutting member(s) out to penetrate the tubular wall. This is due to the conversion of rotational force to linear force via a helical profile.

The helical profiled member may be a single activation member optionally with a varying pitch and/or lead, relating to helix angles. Optionally the pitch and/or lead for the helical member does not change.

Once the cutting member(s) have penetrated the tubular, the anchor mechanism can be disengaged via mechanical or hydraulic means allowing the tool to be picked up. At this point the cutting member(s) may still be engaged into the casing, and therefore the tool may be moved vertically with the torque still in the string/drill string. This motion aids the generation of a helical cut in the conduit.

Optionally, travel joint, a bumper sub or similar device could be incorporated into the tool assembly to allow the cutter body to be moved vertically enabling the tool to create a cut without un-setting the anchor.

With the anchor set, the drill string may be rotated further. This will cause the activation member(s) to move further down the helical profiled member(s), disengaging from the cutting member(s) which allows them to retract back into the cutting tool body.

The cutting tool can then be repositioned in the wellbore at the next pre-determined cutting depth. The anchor mechanism can be reactivated at this new depth, to again anchor the tool in the conduit. Once again, the activation member(s) are driven axially down the helical profiled member(s) via the rotation of the drill string until it drives the next set of cutting member(s) out of the tool body. The cutting process is repeated, with further perforations or cuts now residing in the conduit.

Optionally, the vertical movement required to make an axially extending cut, alternative to drill string movement, may be generated by a helical profiled member and/or similar device.

Optionally, the anchor contains a mechanism that allows it to be disconnected from the downhole tubing cutting tool and be left anchored and positioned in the well bore.

Optionally, the anchor contains a sealing element device that can be expanded and set against the casing wall to seal off the assembly from above and below. The packing element may be dormant until activated by a pre-determined pressure or when compressive or tensile load is seen at the anchor.

The downhole tubular cutting tool, once disconnected from the anchor mechanism, may have an open-ended profile to allow for cementing operations to be carried out if required.

The release mechanism may provide a means to disconnect the cutting tool from the anchor.

Using the sealing element provides the option to temporarily set the sealing element(s) prior to disconnection, allowing for confirmation of communication between two set of perforations or cuts. Alternatively, it could be used to communicate between the A annulus, that is the annulus between the production tubing and the innermost casing, and the B annulus, the annulus between the casing sections, and optionally clean out the B annulus contents at the same time.

Another option would be to permanently set the sealing element(s) along with the anchor mechanism, prior to disconnection from the cutting tool. This would provide a base for a multitude of downhole operations including but not limited to cementing, tagging, and testing and may potentially save a trip in hole by using the sealing element to isolate the wellbore.

Optionally, a packer can be run above the system to provide a means of conducting a squeeze operation in a single trip.

Optionally, the cutting tool can have a multitude of cutting member(s) that may be staged to cut in sequence thus reducing the load on the linear force mechanism. Therefore, depending on the number of cutting member(s) in said cutting tool, there could be multiple helical cuts at set depths in the conduit depending on the assembly lay-out. The cutting tool, sealing element and activation member(s) can be of modular design and can therefore be assembled in a multitude of configurations.

As mentioned previously, a through bore may be provided throughout the tool to allow for fluids such as, but not limited to, cement and members such as, but not limited to, darts, balls and other downhole devices to pass through the tool.

The anchor tool may have a set of springs acting behind the slips that would stop the slips from retracting from the conduit wall and back into the tool body.

Optionally, the anchor tool has a set of pistons that are energized by springs. Optionally once the pistons see the required differential pressure across them, they will overcome the spring load and allow the slips to move outward and contact the conduit wall.

Optionally, the anchor tool may have a flow activated valve that allows circulation at low rates and will not be affected, once a high flow rate is reached the valve moves and straddles and seals the ports which allow tubing to annulus flow. Once the ports are closed the pressure in the string can be increased relative to the annulus. This pressure may act upon the pistons in the anchor allowing the slips to operate and contact the conduit wall. This configuration would be deactivated by bleeding any pressure off in the drill string and stopping flow to the drill string. Once the pressure is bled off the spring in the flow activated valve in the anchor moves the valve and uncovers the ports to allow tubing to annulus flow.

The anchor tool could alternatively be a mechanically activated tool, utilizing drag springs or drag blocks to contact the conduit wall while running into the well bore. A mechanical latch mechanism such as but not limited to a J-slot prevents any unwanted setting of the anchor until the required depth is reached. Rotation and up or down movement at the anchor unlatches the latch mechanism and allows the anchor slips to deploy and contact the conduit wall once compression or tension is applied to the tool.

According to a third aspect of the disclosure there is provided a downhole cutting tool for perforating a tubular in an oil or gas well, comprising:

- a body comprising at least one radially moveable cutting member; and
- at least one activation member configured to move axially along the tool;
- wherein movement of the activation member is generated by rotation of at least one helical profiled member via rotation of the string; and
- wherein the at least one activation member is configured to actuate the at least one cutting member from a first retracted configuration to a second extended configuration.

The cutting tool may be configured for mounting on an appropriate support, such as a tubular string, and rotation of the activation member may be generated by rotation of the string.

The cutting member may be moved radially outwards to perforate a surrounding tubular. Alternatively, or in addition, the at least one cutting member may perforate the tubular by forming a cut, which may be a helical cut, in the tubular.

The cutting members may be activated singularly, or in sequence, or simultaneously.

Optionally the at least one activation member moves axially along the helical profiled member. Optionally the helical profiled member is disposed within the tool body. Optionally the tool comprises at least two activation members. Optionally the at least two activation members are singular or plural acting in series, sequence and/or unison.

Optionally the tool further comprises at least one anchor mechanism that is hydraulically or mechanically activated. Optionally the at least one anchor mechanism comprises a series of slips configured to contact a wellbore wall when activated. Optionally the anchor mechanism thereby anchors the tool assembly to prevent rotational and/or axial movement. Optionally the at least one anchor mechanism comprises one or more anchors.

Optionally the tool further comprises at least one hydraulically or mechanically activated annular sealing tool. Optionally the at least one annular sealing tool remains in position within the wellbore upon disconnection of the at least one annular sealing tool from the string.

Optionally the cutting tool is modular in design. Optionally the cutting tool may be arranged/assembled in multiple configurations with, for example, varying numbers of blades, or blades being located in various longitudinal positions along the tool body, and so forth.

Optionally the cutting tool forms part of a tool assembly that comprises the cutting tool, a disconnect sub, and the anchor mechanism.

Optionally the tool body comprises a through bore which allows fluids (e.g. cement, surfactants) and objects or members such as darts, balls, etc. to pass through the bore of the tool. Optionally the through bore allows the bore to be sealed off again when required.

Optionally the helical profile of the helical profiled member comprises uniform pitch and/or leads. Optionally the helical profile may comprise varying pitch and/or leads relating to helix angles.

According to the present disclosure there is further provided a method of perforating a downhole tubular in an oil or gas well, the method comprising:

providing a downhole cutting tool having a body comprising at least one radially moveable cutting member;

activating at least one activation member configured to move axially along the cutting tool, by rotating at least one helical profiled member via rotation of the string, thereby generating movement of the activation member; and actuating the at least one cutting member from a first retracted configuration to a second extended configuration by activating the at least one activation member.

According to a further aspect of the disclosure there is provided a downhole cutting tool for perforating a tubular in an oil or gas well, comprising:

a body;

a radially moveable cutting member mounted on the body;

a helical profiled member rotatable relative to the body; and an activation member axially movable relative to the body;

wherein rotation of the helical profiled member generates axial movement of the activation member, and wherein the activation member is configured to actuate the cutting member from a retracted configuration to an extended configuration.

According to another aspect of the present disclosure there is provided a method of perforating a downhole tubular in an oil or gas well, the method comprising:

axially translating an activation member along a body of a downhole cutting by rotating a helically profiled member; and translating the activation member into engagement with a cutting member mounted on the body to actuate the cutting member from a retracted configuration to an extended configuration.

The various aspects of the present disclosure described herein and as recited in the appended claims can be practiced alone or in combination with one or more of the other aspects, as will be appreciated by those skilled in the relevant arts. The various aspects of the disclosure can optionally be provided in combination with one or more of the optional features of the other aspects. Also, optional features described in relation to one example can optionally be combined alone or together with other features in different examples of the disclosure.

Various examples and aspects of the disclosure will now be described in detail with reference to the accompanying figures. Still other aspects, features and advantages of the present disclosure are readily apparent from the entire description thereof, including the figures, which illustrate a number of exemplary aspects and implementations. The disclosure is also capable of other and different aspects and implementations, and its several details can be modified in various aspects, all without departing from the scope of the present disclosure. Accordingly, the drawings and descriptions are to be regarded as illustrative in nature, and not as restrictive. Furthermore, the terminology and phraseology used herein is solely used for descriptive purposes and should not be constructed as limiting in scope.

Language such as "including", "comprising", "having", "containing" or "involving" and variations thereof, is intended to be broad and encompass the subject matter listed thereafter, equivalents and additional subject matter not recited, and is not intended to exclude other additives, components, integers or steps. Likewise, the term "comprising" is considered synonymous with the terms "including" or "containing" for applicable legal purposes.

BRIEF DESCRIPTION OF THE DRAWINGS

In the accompanying drawings.

DETAILED DESCRIPTION OF THE DRAWINGS

Figure 1:
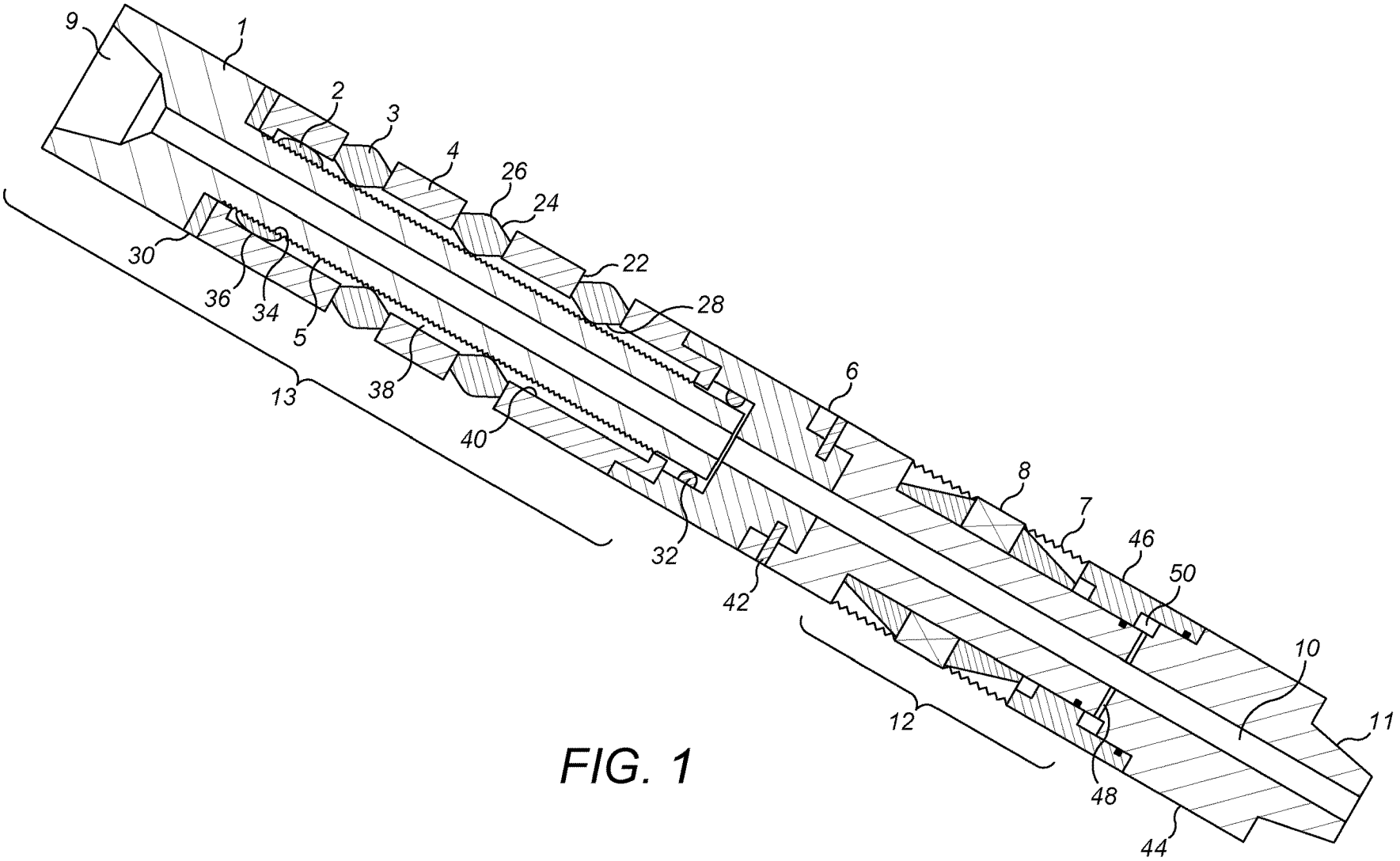
FIG. 1 shows a schematic side view of the proposed embodiment of the tool.

FIG. 1 shows a schematic side view of one possible embodiment of the device which encompasses the cutting tool 13, anchor 12 and disconnect tool 6. The tool assembly can be made up to the drill string 20 (FIG. 2) using the upper drill string connection 9. The lower connection 11 allows the tool to be positioned at any location within the drill string 20 and allows for further components to be added below such as but not limited to scrapers, mills, etc. The tool assembly is illustrated located within a conduit 14 which will typically be a section of casing, but may be production tubing, liner, or the like. The design of the tool allows for a through bore 10 to be maintained such that fluid and objects such as balls, darts and plugs may pass through the tool.

FIG. 1 shows the cutting tool 13 which comprises of a series of radially movable cutting members 3 housed in windows or ports 22 in the tool body 4. The windows 22 permit radial movement of the respective cutting members 3 while restricting axial and circumferential movement. The cutting members 3 are circumferentially and axially spaced along the body 4. An outer surface 24 of each cutting member 3 tapers to a point 26 to facilitate penetration of the surrounding conduit 14. An inner cutting member surface 28 is cammed to cooperate with an activation member 2.

The helical profiled member 1 is located within the tool body 4. The member 1 is secured to prevent axial movement relative to the body 4 but is rotatable relative to the body 4 and is supported on appropriate bearings 30, 32. An outer surface of the member features a helical profile 5, for example an Acme thread, but any appropriate thread form may be utilised. The profile 5 cooperates with a corresponding profile 34 provided on an inner surface of each activation member 2. Each activation member 2 has a cammed outer surface 36 to cooperate with the inner cutting member surfaces 28, as will be described below. The activation members 2 are located in respective axially extending slots 38 on the tool body inner diameter 40; the slots 38 permit axial translation of the activation members 2 but prevent radial and circumferential translation of the members 2.

The upper drill string connection 9 is provided in the upper end of the helical profiled member 1 such that, as the drill string is rotated (with the tool body 4 fixed against rotation), the helical profiled member 1 rotates and the activation member 2 is translated along the axis of the tool. After a predetermined torque value and/or number of rotations of the string, the activation member 2 will activate the cutting member 3. In particular, the activation member 2 will be axially translated down through the tool body 4 and the activation member cam surface 36 will engage with an inner cutting member cam surface 28, further axial translation pushing the cutting member 3 radially outwards and into contact with the inner surface of the surrounding conduit 14. The radial movement of the cutting member 3 is continued to the extent necessary to breach the wall of conduit 14; the operator will be aware of the dimensions and material properties of the conduit 14 and whether the conduit 14 is surrounded by a cement sheath, and will thus have determined the radial extension of the cutting member 3 that will be required to perforate the conduit 14 and configured the tool accordingly.

Further rotation continues the movement of the activation member 2 beyond the cutting member 3, allowing the cutting member 3 to retract. Where multiple cutting members 3 are present a continuation of the above will activate cutting members 3 sequentially or in unison. Sequential operation allows all the torque being applied to the tool to be utilised to translate a single cutting member 3 at a time.

FIG. 1 depicts an embodiment of the tool with a disconnect tool 6, which allows the cutting tool 13 to be recovered to surface, leaving the anchor 12 downhole if desired. The disconnect tool 6 is provided between the lower end of the cutting tool 13 and the anchor 12 and includes releasable couplings, such as shear pins 42. Of course, the force necessary to shear the pins 42, which may be at least one of string torque and tension, will be higher than that necessary to operate the cutting tool 13.

The anchor 12 comprises a tubular body 44 which carries upper and lower anchor slips 7, and a sealing element 8 between the slips 7. The illustrated anchor 12 is fluid pressure activated and includes an external actuating piston 46 having an upper end face bearing against the lower slips 7. A pressure-communicating port 48 extends between the tool bore 10 and an annular chamber 50 provided between the anchor body 44 and the piston 46 such that an increase in pressure within the tool bore 10 is communicated to the chamber 50 and urges the piston 46 to travel upwards and against the slips 7, causing the slips 7 to extend radially outwards to grip the conduit 14, and the sealing element 8 to be axially compressed and radially extended into sealing contact with the conduit.

The anchor 12 may be initially retained in a dormant position, for example by provision of shear couplings between the piston 46 and the body 44, or a spring may be provided to bias the piston 46 towards a slip and seal retracting position.

The fluid pressure required to set the anchor 12 may be achieved by, for example, providing a flow restriction or occlusion below the anchor 12 and operating surface pumps to increase the pressure in the bore 10. The flow restriction may take any suitable form, for example a valve that remains open at low flow rates but closes when the flow rate through the valve increases, or may be a ball 105 or dart that may be dropped into the string from surface to land on a seat below the anchor 12. The ball or dart may be subsequently displaced, for example by deforming the ball or by reconfiguring the dart to pass through the seat.

Figure 2:
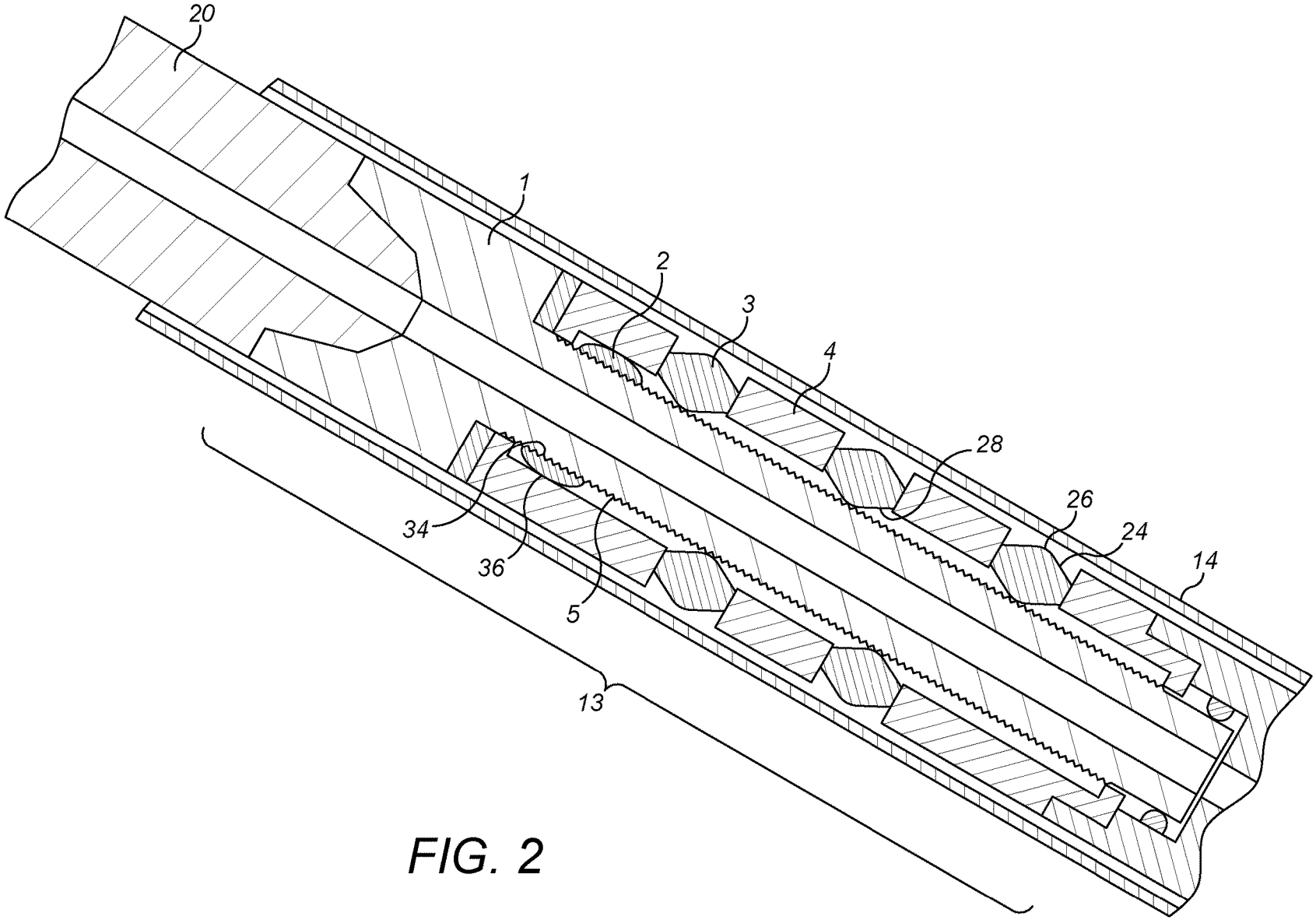
FIG. 2 shows a perspective view of the proposed cutting tool in the dormant position, prior to making any cuts.
Figure 3:
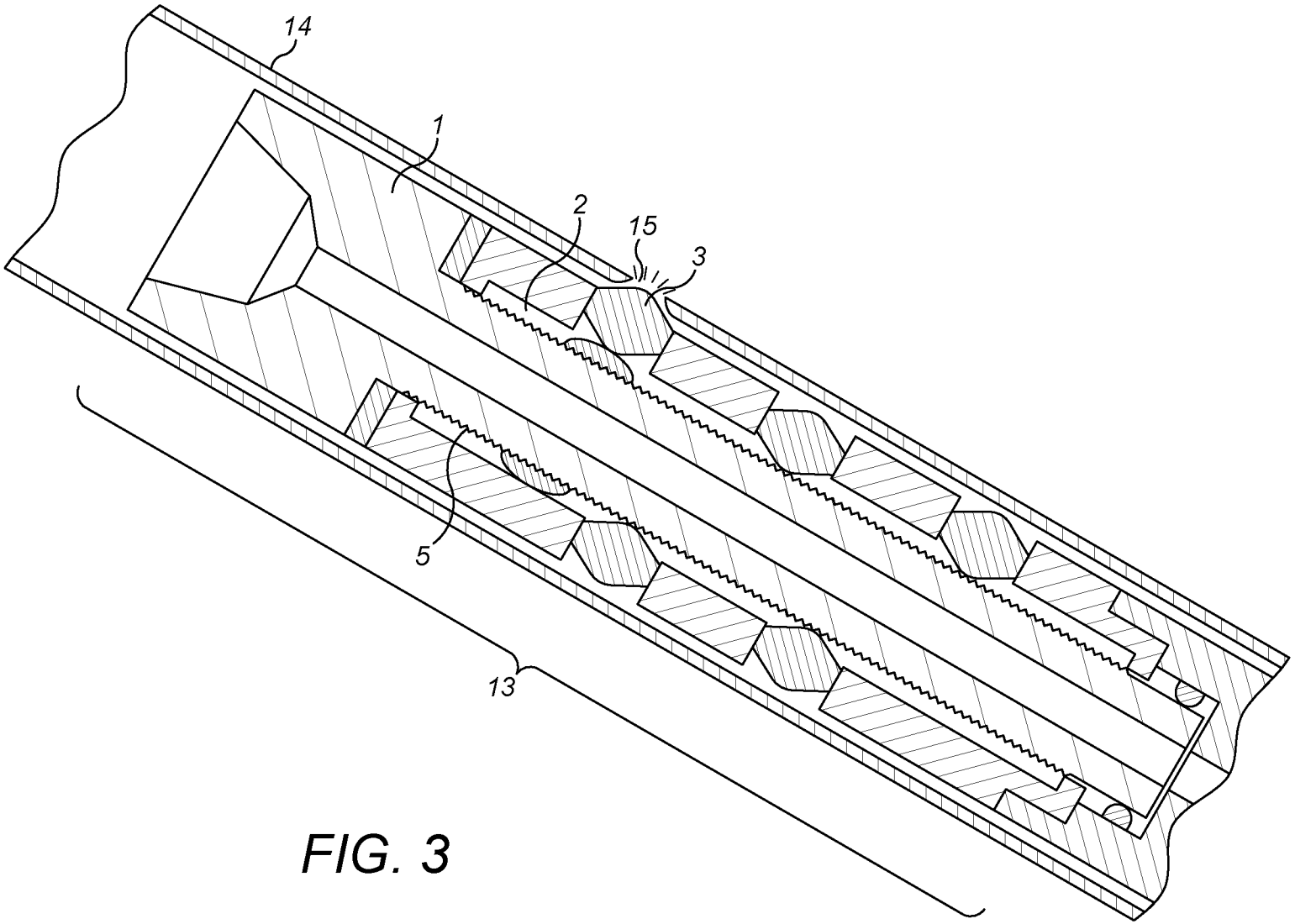
FIG. 3 shows a perspective side view of the proposed cutting tool during a conduit cut.
Figure 4:
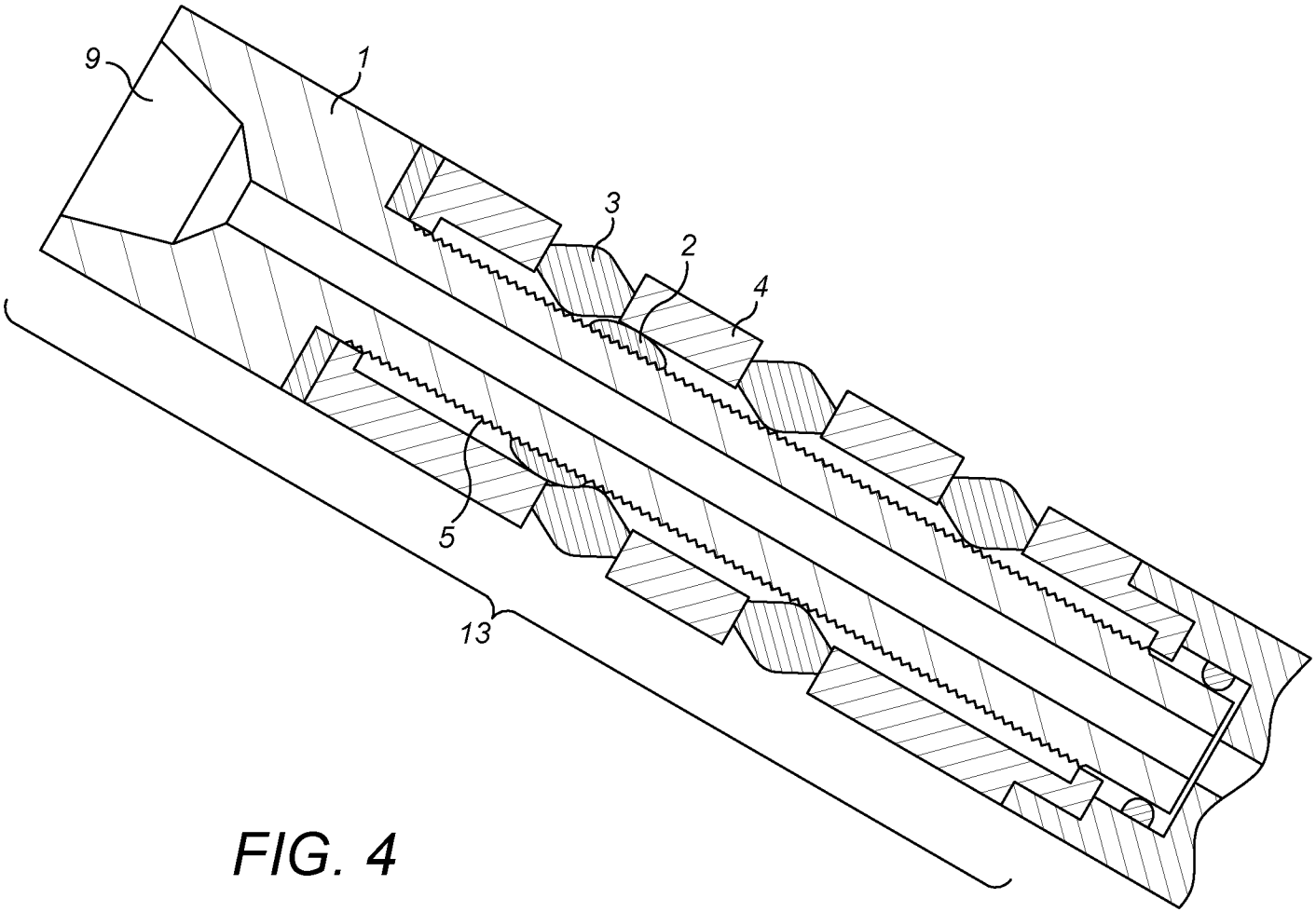
FIG. 4 shows a perspective side view of the proposed cutting tool following a conduit cut.

FIGS. 2, 3 and 4 show the cutting tool 13 with the activation member 2 at various positions, showing the activation cycle of the cutting member 3.

In FIG. 2, rotation of the drill string 20 and the helical profiled member 1 has moved the activation member 2 along the axis of the helical profiled member 1 and into contact with the uppermost cutting member 3.

FIG. 3 shows the activation member 2 having moved further along the axis of the helical profiled member 1 and fully energising the cutting member 3, driving the cutting member 3 outwards in contact with the conduit 14 being cut, resulting in a cut 15 to the conduit.

In FIG. 4, the cutting tool 13 has seen further rotation moving the activation member 2 further along the axis of the helical profiled member 1. The activation member 2 is positioned in a manner so that the cutting tool 13 is dormant, and the activation member 2 is not activating any of the cutting members 3. This allows the uppermost cutting member 3 to retract back into the tool body 4.

Figure 5:
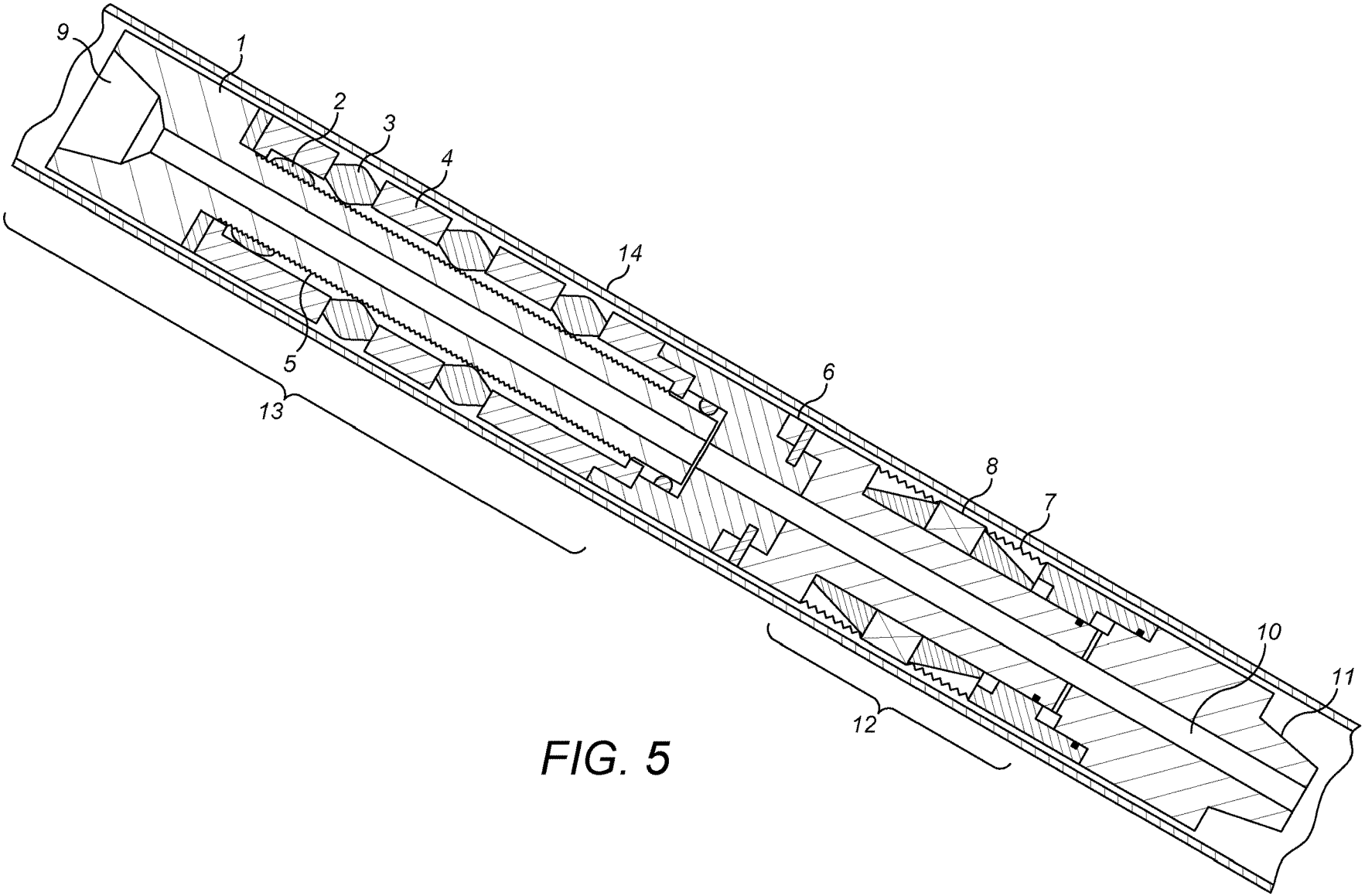
FIG. 5 shows a schematic side view of the proposed cutting tool assembly whilst running into the conduit.

FIG. 5 shows the cutting tool assembly whilst running into the conduit 14. The activation member 2 is at the upper end of the helical screw feature 5 and the cutting members 3 have not been activated.

Figure 6:
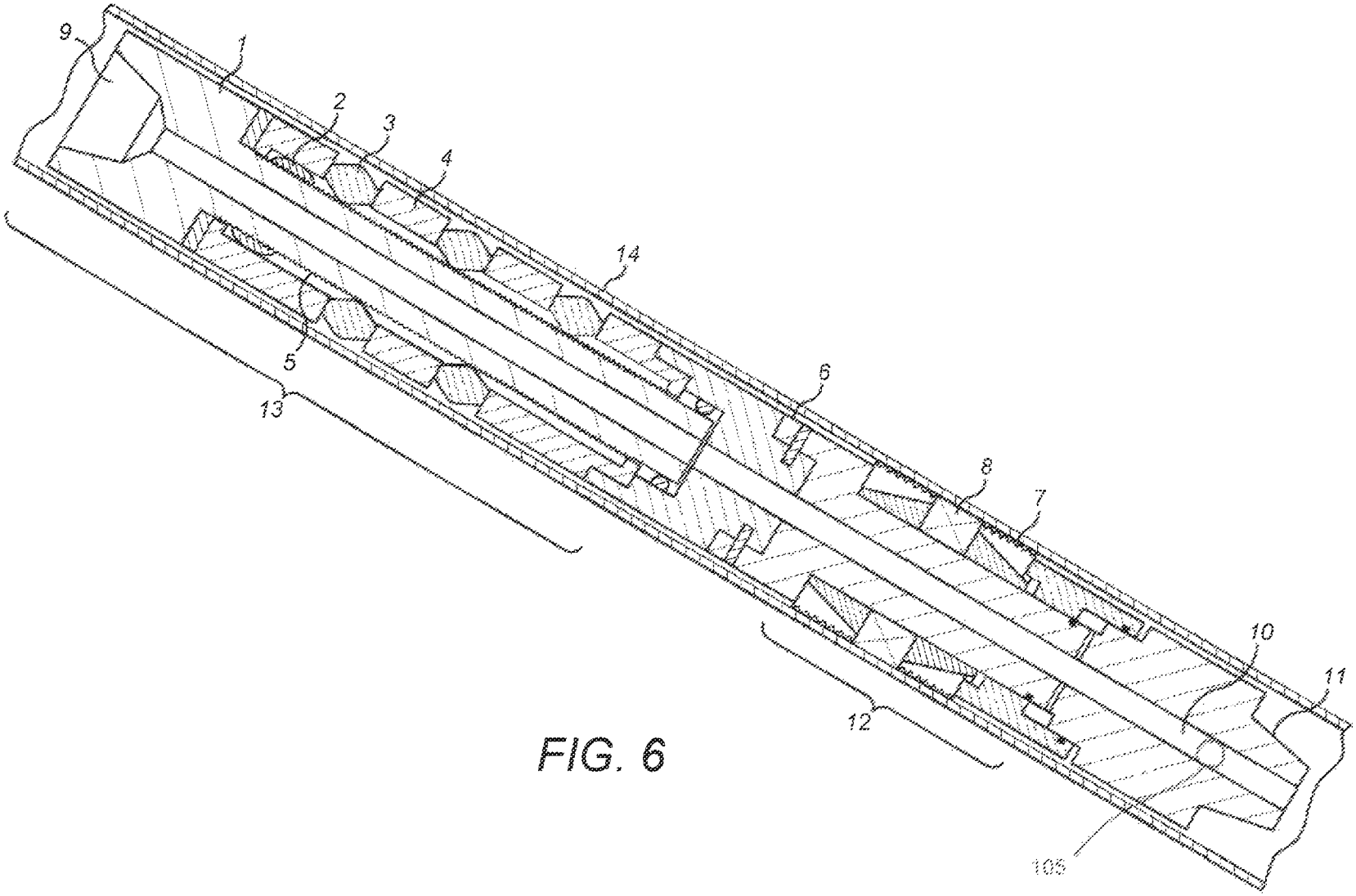
FIG. 6 shows a schematic side view of the proposed cutting tool assembly with the anchor engaged, prior to making any conduit cuts.

FIG. 6 shows the tool in position at the required cut depth with the anchor 12 activated and engaged. The anchor slips 7 and the sealing element 8 are engaged with the conduit bore 14, securing the tool in place and allowing for rotation of the drill pipe to be transmitted to the helical profiled member 1.

Figure 7:
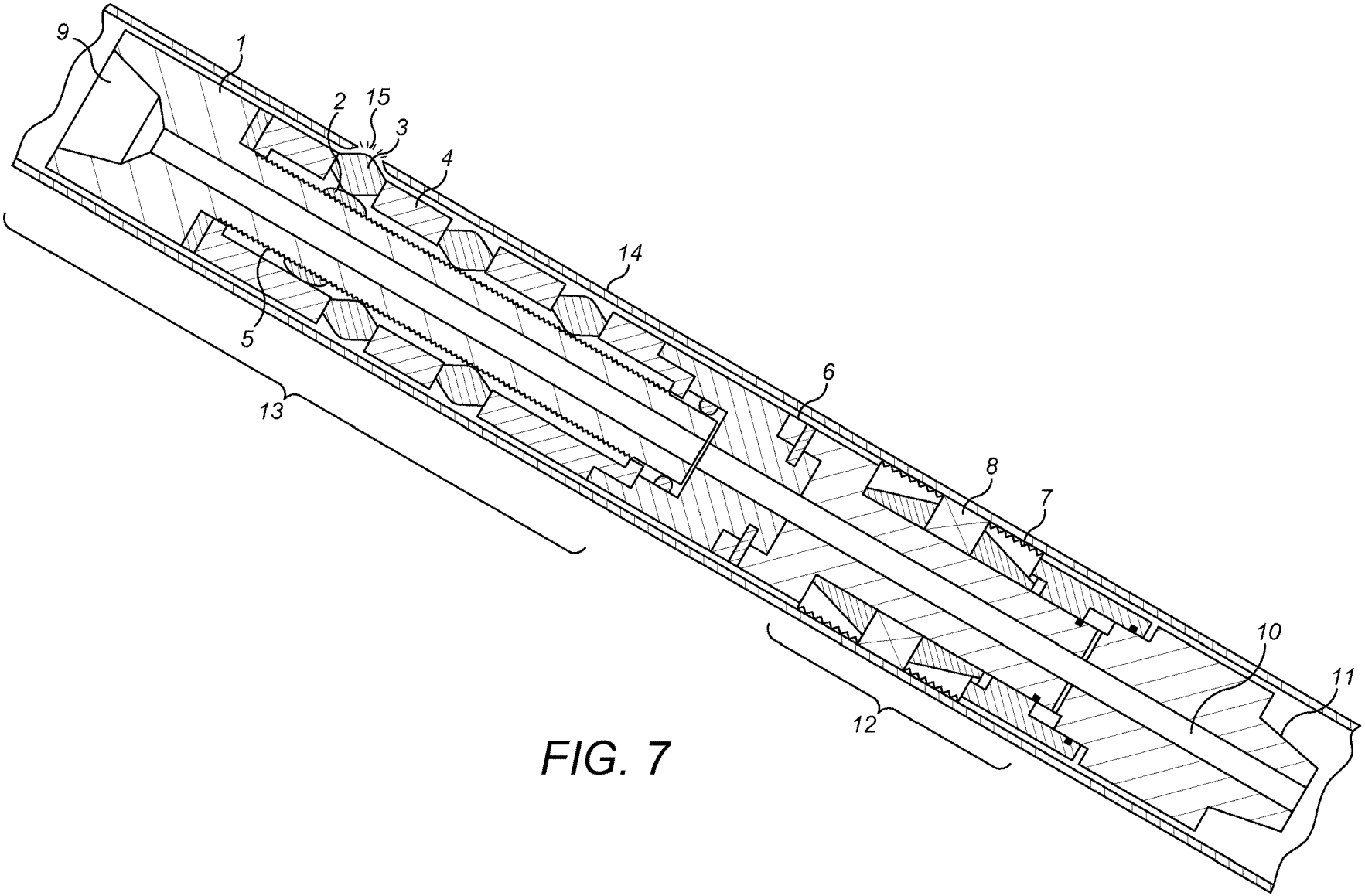
FIG. 7 shows a schematic side view of the proposed cutting tool assembly during the initial conduit cut.

FIG. 7 shows the position of the components following the transmission of torque to the helical profiled member 1.

The drill string rotation results in the activation member 2 moving along the axis of the helical screw feature 5 and driving the cutting member 3 outwards into contact with the conduit 14, resulting in a cut 15 being made. At this point the anchor 12 is still set in the conduit bore 14.

Figure 8:
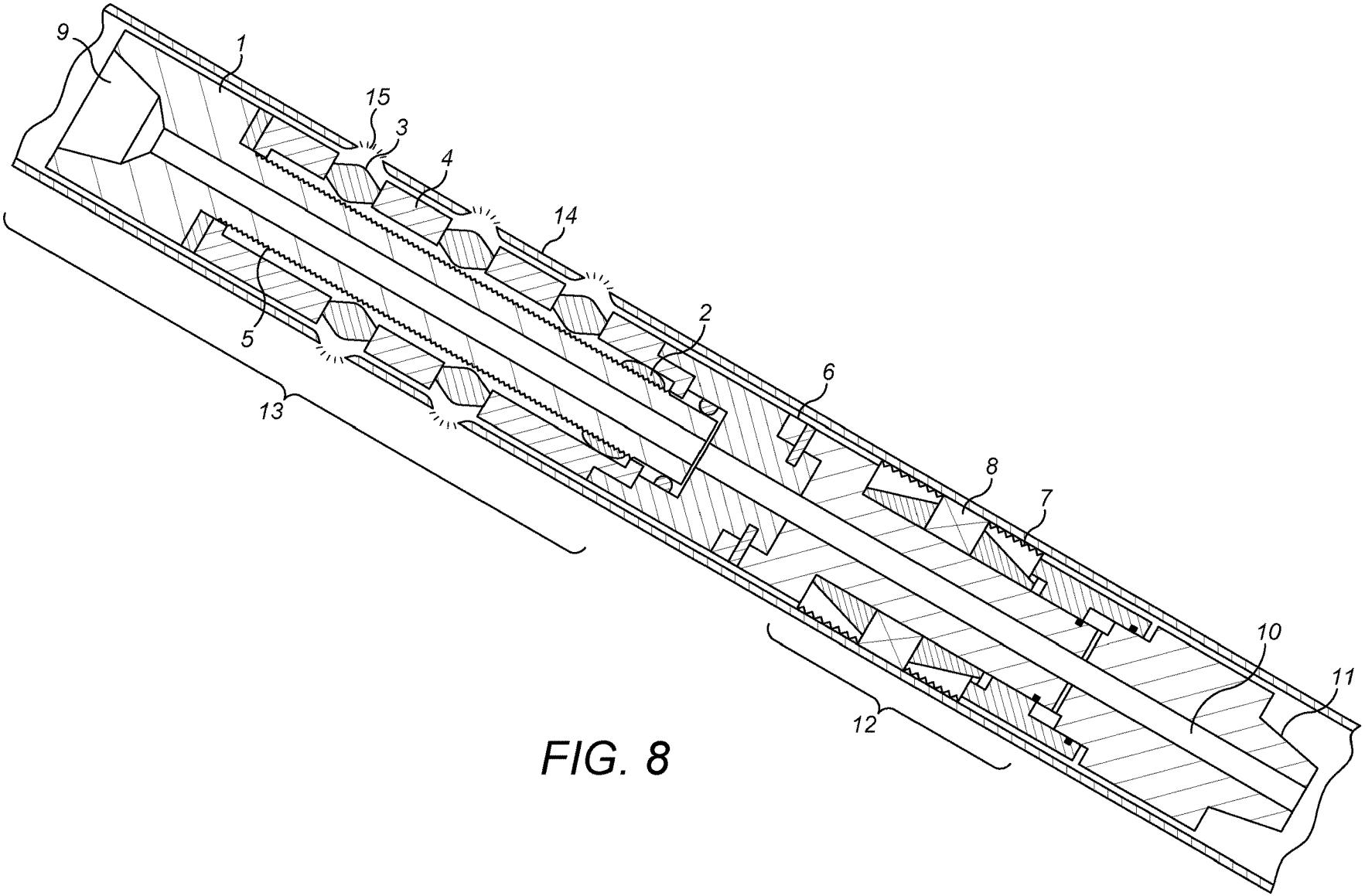
FIG. 8 shows a schematic side view of the proposed cutting tool assembly following the completion of the conduit cuts with the anchor still set.

FIG. 8 shows the positioning of components once the required cuts 15 have been made in the conduit 14. The activation member 2 is at the end of the helical screw feature 5 and the cutting members 3 have retracted into the tool body 4 after sequentially making the cuts 15 as the activation member 2 moved along the helical profiled member 1 (as shown in FIGS. 2 to 4). The anchor 12 is still set with the anchor slips 7 and the sealing element 8 engaged with the conduit 14.

Figure 9:
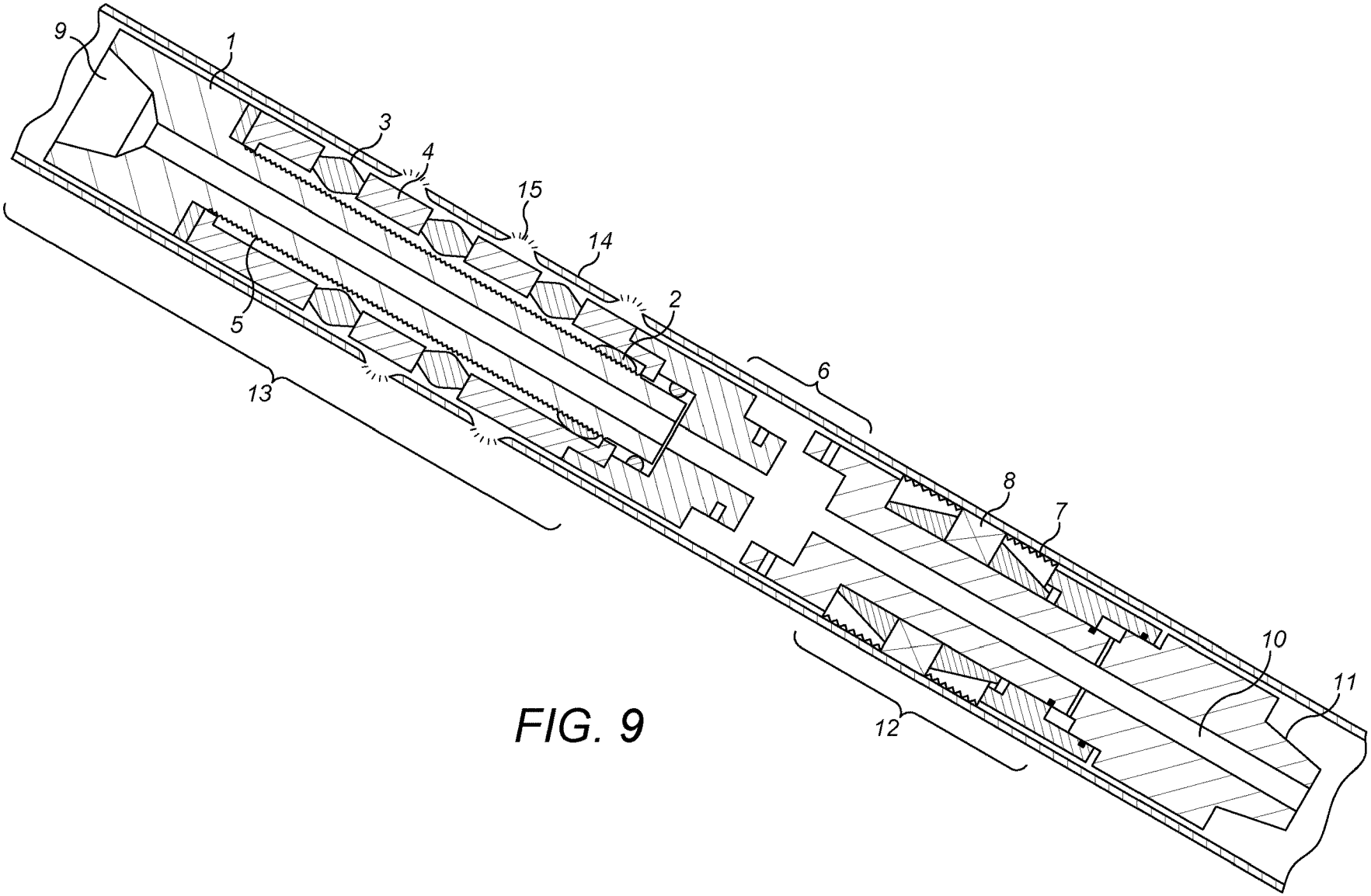
FIG. 9 shows a schematic side view of the anchor set in the conduit with the proposed cutting tool disconnected via the disconnect sub.

FIG. 9 illustrates the option to disconnect from the anchor 12, leaving the anchor 12 set downhole. In this figure the cutting tool 13 can be seen to have been released from the anchor 12 by the disconnect tool 6, for example by application of an over-torque, overpull, or combination of both. The tool through bore 10 is maintained and therefore provides a means of placing cement or other fluids on top of the anchor 12. The cutting members 3 have retracted into the body and the cutting tool 13 can be pulled out of hole.

Figure 10:
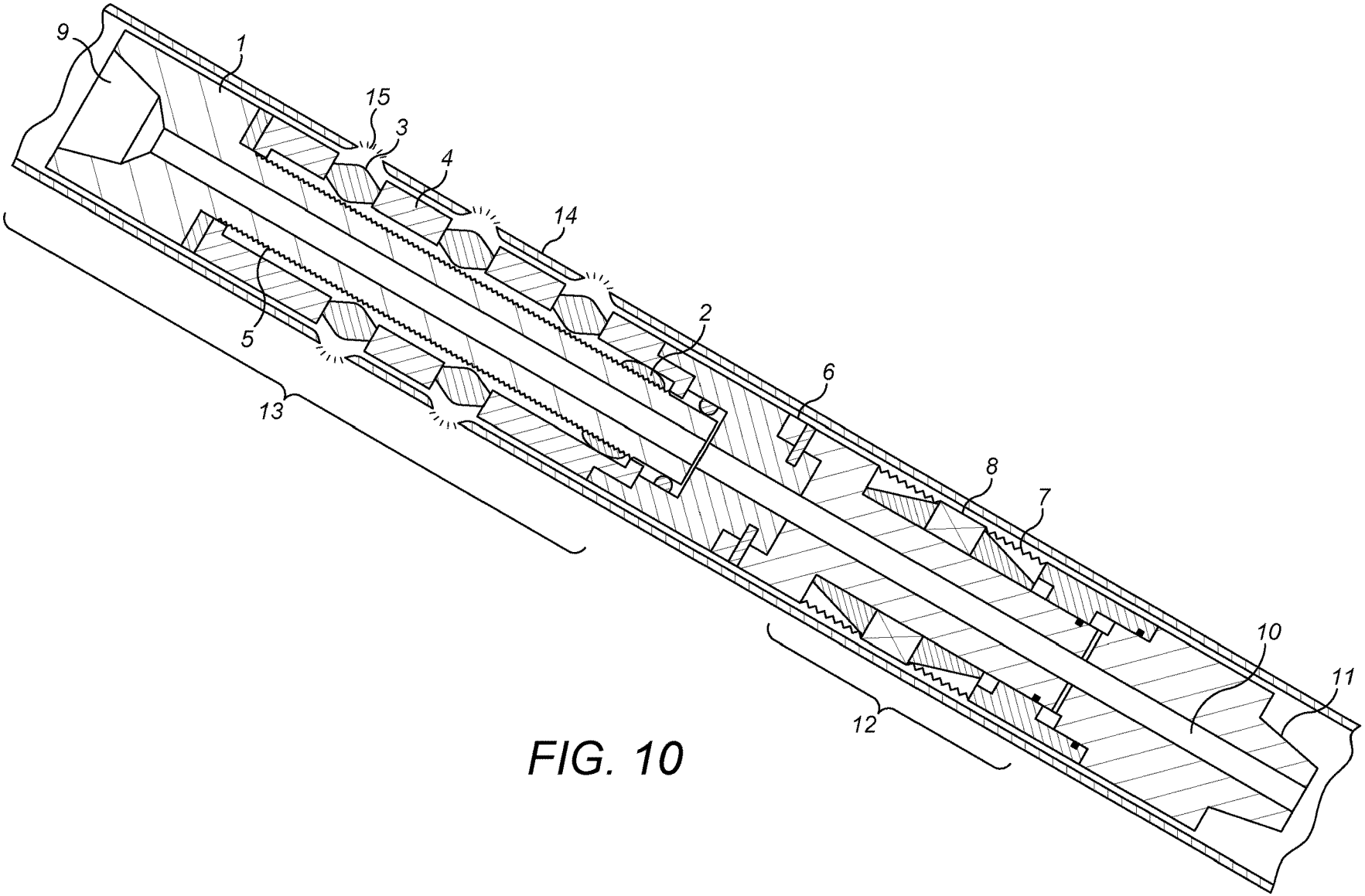
FIG. 10 shows a schematic side view of the proposed cutting tool assembly following the completion of the conduit cuts, with the anchor released, being recovered to surface.

FIG. 10 shows the option of recovering the system by releasing the anchor 12 and recovering the anchor 12 and cutting tool 13 from the wellbore. As the cutting members 3 are retracted this can be completed without risk of engaging with the existing cuts 15 in the conduit 14.

From the above description it will be apparent that the illustrated tool assembly allows downhole tubing to be perforated by a relatively simple operation, and without the use of perforation charges. As described above, the torque to operate the tool may be provided via a drill pipe string, which may be rotated at surface using a top drive or rotary table. In other examples the torque may be provided by other arrangements, for example downhole motors.

The above example features a helical profile 5 having a thread-like form, however in other examples the activation members 2 may travel along a plain helical slot or groove. The form of the helical profile may be constant, such that the relationship between rotation of the helical profiled member 1 and axial translation of the activation member 2 remains constant as the activation members 2 travel down the member 1. However, in other examples the helix angle or other feature of the profile may vary such that, for example, with a constant rate of rotation of the drill string 20 and the member 1, the rate of axial translation of an activation member 2 decreases as the member 2 engages a cutting member 3.

The tool is described above for use in perforating tubing, but in certain operations an operator may wish only to deform a tubular and in such an example the cutting members may have a different external profile.

When a cutting member is extended into contact with the surrounding tubular there will be a tendency for the tool to move towards the opposite side of the bore. The radial extension of the cutting members may be selected to accommodate this movement, or in other examples stabilising or supporting members may be provided to limit the movement of the tool. The stabilising or supporting members may be static, for example solid stabiliser blades, or support members may extend from the opposite side of the body in unison with the cutting members. Such support members may be activated in a similar manner to the cutting members, that is via activation members that are axially translated down the tool body.

The cutting members 3 may be in sealing engagement with the respective body windows 22 or may simply be a close or loose fit with the windows 22. If in sealing engagement the extension of the members 3 may be assisted by internal tool pressure if, for example, a flow restriction is provided in the bore 10 below the tool. The cutting members 3 may be biased towards the retracted configuration by appropriate springs or may simply be free to retract once the activation member 2 has moved past the member 3.

The tool bore 10 may be selectively occluded by, for example, dropping a ball 105 or dart into the tool. The ball or dart may be subsequently displaced to reinstate flow through the tool.

REFERENCE NUMERALS helical profiled member 1
activation member 2
cutting members 3
tool body 4
helical profile 5
disconnect tool 6
anchor slips 7
sealing element 8
upper drill string connection 9
through bore 10
lower drill string connection 11
anchor 12
cutting tool 13
conduit 14
cut 15
drill string 20
windows 22
cutting member outer surface 24
cutting member point 26
cutting member inner surface 28
bearings 30, 32
activation member profile 34
cam surface 36
axially extending slots 38
tool body inner diameter 40
shear pins 42
anchor body 44
actuating piston 46
pressure-communicating port 48
chamber 50

What is claimed is:

1. A downhole cutting tool for perforating a downhole tubular in an oil or gas well, comprising:

a body;

an anchor mechanism comprising at least one anchor for selectively anchoring the body relative to a surrounding downhole tubular;

a radially moveable cutting member mounted on the body and having an inner cam surface;

a helical profiled member rotatable relative to the body and for coupling to a drill string;

and an activation member longitudinally movable relative to the body and having an outer cam surface;

wherein, with the anchoring mechanism activated to anchor the body to a surrounding downhole tubular, rotation of the helical profiled member relative to the body and driven by rotation of a drill string coupled to the helical profiled member, generates longitudinal movement of the activation member, and wherein the outer cam surface of the activation member is configured to cooperate with the inner cam surface of the radially movable cutting member and actuate the radially movable cutting member from a retracted configuration to an extended cutting configuration.

2. A downhole cutting tool as claimed in claim 1, wherein the tool further comprises an annular sealing tool.

3. A downhole cutting tool as claimed in claim 2, wherein the tool comprises separable parts allowing a first part of the tool to be retrieved from a well and a second part to remain in the well, and wherein the second part includes the annular sealing tool.

4. A downhole cutting tool as claimed in claim 1, the tool comprising multiple radially moveable cutting members and wherein the cutting members are actuated at least one of singularly, in sequence, and simultaneously.

5. A downhole cutting tool as claimed in claim 1, wherein the tool comprises at least two activation members.

6. A downhole cutting tool as claimed in claim 1, wherein the tool body comprises a through bore which allows fluids and members to pass through the bore of the tool.

7. A downhole cutting tool as claimed in claim 1, wherein the activation member is longitudinally movable from a first position where the activation member is not in contact with the cutting member to a second position where the activation member is in contact with the cutting member.

8. A method of perforating a downhole tubular in an oil or gas well, the method comprising:

locating a downhole cutting tool in a downhole tubular, the downhole cutting tool having a body and a helically profiled member, the downhole cutting tool coupled to a drill string;

anchoring the cutting tool in the downhole tubular;

rotating the drill string to cause rotation of the helically profiled member relative to the body;

in response to rotating the helically profiled member, longitudinally translating an activation member along the body of the downhole cutting tool and along the helically profiled member; and translating an outer cam of the activation member into engagement with an inner cam of a cutting member mounted on the body to radially move the cutting member from a retracted configuration to an extended configuration.

9. The method of claim 8, further comprising sealing the cutting tool in the downhole tubular.

10. The method of claim 8, further comprising retrieving a first part of the downhole cutting tool from the downhole tubular while a second part of the tool remains in the downhole tubular.

11. The method of claim 10, further comprising sealing the downhole tubular with the second part of the tool.

12. The method of claim 8, wherein radially moving the cutting member to the extended position perforates the downhole tubular.

13. The method of claim 8, further comprising actuating multiple cutting members in sequence.

14. The method of claim 8, further comprising translating multiple activation members.

15. The method of claim 8, further comprising passing fluid through the downhole cutting tool, and then occluding a through bore in the downhole cutting tool.

16. The method of claim 8, further comprising translating the activation member to disengage the activation member from the cutting member.

* * * * *